US007832706B2

(12) United States Patent
Judge

(10) Patent No.: US 7,832,706 B2
(45) Date of Patent: Nov. 16, 2010

(54) RAM BOP POSITION SENSOR

(75) Inventor: Robert Arnold Judge, Houston, TX (US)

(73) Assignee: Hydrill USA Manufacturing LLC, Houston, TX (US)

( * ) Notice: Subject to any disclaimer, the term of this patent is extended or adjusted under 35 U.S.C. 154(b) by 825 days.

(21) Appl. No.: 11/675,861

(22) Filed: Feb. 16, 2007

(65) Prior Publication Data

US 2008/0197306 A1 Aug. 21, 2008

(51) Int. Cl.
*E21B 33/06* (2006.01)

(52) U.S. Cl. ..... 251/1.3; 251/1.1; 166/85.4

(58) Field of Classification Search ..... 251/1.1, 251/1.2, 1.3; 166/84.1, 85.1, 85.4
See application file for complete search history.

(56) References Cited

U.S. PATENT DOCUMENTS

| | | | | |
|---|---|---|---|---|
| 4,647,002 | A | 3/1987 | Crutchfield | |
| 4,922,423 | A | 5/1990 | Koomey et al. | |
| 5,150,049 | A * | 9/1992 | Schuetz | 324/207.12 |
| 5,320,325 | A | 6/1994 | Young et al. | |
| 5,407,172 | A | 4/1995 | Young et al. | |
| 5,655,745 | A | 8/1997 | Morrill | |
| 5,897,094 | A | 4/1999 | Brugman et al. | |
| 6,244,560 | B1 | 6/2001 | Johnson | |
| 6,509,733 | B2 | 1/2003 | Blubaugh et al. | |
| 6,554,247 | B2 | 4/2003 | Berckenhoff et al. | |
| 7,023,199 | B2 | 4/2006 | Blubaugh et al. | |
| 7,121,185 | B2 | 10/2006 | Alrefai | |
| 7,274,989 | B2 | 9/2007 | Hopper | |

OTHER PUBLICATIONS

International Search Report for PCT/US2009/032918 mailed Jun. 2, 2009.
International Search Report for PCT/US2008/053840 mailed Jun. 24, 2008.
Written Opinion for PCT/US2008/053840 mailed Jun. 24, 2008.

* cited by examiner

*Primary Examiner*—John K Fristoe, Jr.
(74) *Attorney, Agent, or Firm*—Potomac Patent Group PLLC

(57) ABSTRACT

A ram-type blowout preventer includes a pair of ram assemblies adapted for controlled lateral movement to and from a vertical bore. Each ram assembly has a hydraulic piston connected at a first end to a ram block and at a second end to a piston tail. A magnetostrictive waveguide tube extends into a bore of at least one piston tail and a permanent magnet is disposed upon the at least one piston tail. The magnetostrictive waveguide tube has a conducting wire to receive an interrogation pulse from a transducer, the interrogation pulse generates a helical return signal in response to a relative position of the permanent magnet with respect to the waveguide tube, and the transducer is configured to receive the helical return signal and output a position of the ram block corresponding to the at least one piston tail.

17 Claims, 2 Drawing Sheets

RAM BOP POSITION SENSOR

BACKGROUND OF INVENTION

1. Field of the Invention

Embodiments disclosed herein relate generally to instrumentation of ram blowout preventers. More specifically, embodiments disclosed herein relate to the direct measurement of position, velocity, and rate of movement of the ram in a ram blowout preventer.

2. Background

Well control is an important aspect of oil and gas exploration. When drilling a well, for example, safety devices must be put in place to prevent injury to personnel and damage to equipment resulting from unexpected events associated with the drilling activities.

The process of drilling wells involves penetrating a variety of subsurface geologic structures, or "layers." Occasionally, a wellbore will penetrate a layer having a formation pressure substantially higher than the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. Such "blowouts" may result in catastrophic destruction of the drilling equipment (including, for example, the drilling rig) and substantially injure or result in the death of rig personnel.

Because of the risk of blowouts, devices known as blowout preventers are installed above the wellhead at the surface or on the sea floor in deep water drilling arrangements to effectively seal a wellbore until active measures can be taken to control the kick. Blowout preventers may be activated so that kicks are adequately controlled and "circulated out" of the system. There are several types of blowout preventers, the most common of which are ram blowout preventers and annular blowout preventers (including spherical blowout preventers).

Ram blowout preventers typically have a body and at least one pair of horizontally opposed bonnets. The bonnets are generally secured to the body about their circumference with, for example, bolts. Alternatively, bonnets may be secured to the body with a hinge and bolts so that the bonnet may be rotated to the side for maintenance access. Interior of each bonnet is a piston actuated ram. The rams may be either pipe rams (which, when activated, move to engage and surround drill pipe and well tools to seal the wellbore), shear rams (which, when activated, move to engage and physically shear any drill pipe or well tools in the wellbore), or blind rams (which, when activated, seal the bore like a gate valve). The rams are typically located opposite of each other and, whether pipe rams, shear rams, or blind rams, the rams typically seal against one another proximate a center of the wellbore in order to completely seal the wellbore.

The rams are generally constructed of steel and fitted with elastomeric components on the sealing surfaces. The ram blocks are available in a variety of configurations allowing them to seal a wellbore. Pipe rams typically have a circular cutout in the middle that corresponds to the diameter of the pipe in the hole to seal the well when the pipe is in the hole; however, these pipe rams effectively seal only a limited range of pipe diameters. Variable-bore rams are designed to seal a wider range of pipe diameters. The various ram blocks may also be changed within the blowout preventers, allowing well operators to optimize the blowout preventer configuration for the particular hole section or operation in progress. Examples of ram type blowout preventers are disclosed in U.S. Pat. Nos. 6,554,247, 6,244,560, 5,897,094, 5,655,745, and 4,647,002, each of which is incorporated herein by reference in their entireties.

Knowledge of the well conditions is extremely important to maintaining proper operation and anticipating future problems of the well. From these parameters, a well may be more effectively monitored so that safe conditions can be maintained. Furthermore, when an unsafe condition is detected, shut down of the well can be appropriately initiated, either manually or automatically. For example, pressure and temperature transducers blowout preventer cavities to may indicate or predict unsafe conditions. These and other signals may be presented as control signals on a control console employed by a well operator. The operator may, for example, affect the well conditions by regulating the rotating speed on the drill pipe, the downward pressure on the drill bit, and the circulation pumps for the drilling fluid. Furthermore, when closure of the BOP rams is desired, it is useful for the operator to have accurate knowledge of where each ram is positioned.

One device that has been employed in the past to develop a signal indicative of the relative position of component parts located in an enclosed housing (not necessarily in a blowout preventer housing) is a potentiometric transducer. Such a device employs one or more sensors that are subject to wear and inaccuracies in the presence of a harsh environment. Moreover, such sensors are subjected to being lifted from the surface of whatever is being tracked, which causes inaccuracies. Also, a loss of power often causes distorted readings because these devices operate incrementally, adding or subtracting values related to specific turns or segments of wire to a previous value. Moreover, devices such as these are notoriously poor high speed devices. Thus, potentiometric measurement would not be useful in accurately determining the position parameter of ram movement. Furthermore, potentiometric transducers are not suitable for use in high speed applications, which renders them of little to no use in ram monitoring applications.

In addition, incremental measuring devices that merely measure intermediate movement have the inherent shortcoming of having to be reset to a baseline in the event of a power failure as well as not providing the precision that is attendant to continuous measurement.

In order to improve the accuracy of measuring the location of the rams, magnetostrictive sensors have been used to monitor and/or control the position of the rams. As described in U.S. Pat. Nos. 5,320,325 and 5,407,172, which are hereby incorporated by reference, the piston driving arm of the ram is placed parallel to a stationary magnetizable waveguide tube. A magnet assembly surrounds the waveguide tube and is attached to a carrier arm that is attached to the tail of the piston.

In U.S. Pat. Nos. 7,023,199, 7,121,185, and 6,509,733, a magnetostrictive sensor is mounted in an internal opening of a sensor port. The sensor has a pressure pipe extending into the internal cavity of the cylinder body and telescopically received in a passage in the rod of a piston and rod assembly.

The positioning of the magnetostrictive sensors in each of the above described patents is less than optimal. For example, in U.S. Pat. No. 7,023,199, because the sensor extends into the cavity of the cylinder body, maintenance to be performed on the sensor unit necessarily requires that the ram not be in operation. The attachment of the sensor and magnets using a carrier arm in U.S. Pat. No. 5,320,325, although not invading the cavity of the cylinder body, may lead to inaccurate measurement of ram positions and may increase the expense of ram BOP fabrication.

Therefore, it is a feature of the present invention to provide an improved apparatus for precisely measuring the location or position of a ram or ram piston in a blowout preventer.

Accordingly, there exists a need for improved apparatus for precisely measuring the location or position of a ram or ram piston in a blowout preventer.

SUMMARY OF INVENTION

In one aspect, the present disclosure is directed to a ram-type blowout preventer having a body, a vertical bore through the body, a horizontal bore through the body intersecting the vertical bore, and a pair of ram assemblies disposed in the horizontal bore on opposite sides of the body, wherein the ram assemblies are adapted for controlled lateral movement to and from the vertical bore, wherein each ram assembly has a hydraulic piston connected at a first end to a ram block and at a second end to a piston tail. Further, a magnetostrictive waveguide tube extends into a bore of at least one piston tail, a permanent magnet is disposed upon the at least one piston tail, and the magnetostrictive waveguide tube has a conducting wire to receive an interrogation pulse from a transducer. Furthermore, the interrogation pulse generates a helical return signal in response to a relative position of the permanent magnet with respect to the waveguide tube, and the transducer is configured to receive the helical return signal and output a position of the ram block corresponding to the at least one piston tail.

In another aspect, the present disclosure is directed to a method to determine a relative position of a ram including reciprocally engaging a magnetostrictive waveguide tube within a bore of a piston tail, longitudinally magnetizing a portion of the waveguide tube with at least one permanent magnet fixed to the piston tail, pulsing a conductive wire located inside the waveguide tube to generate a toroidal magnetic field, wherein a return signal is produced when the toroidal magnetic field encounters the longitudinally magnetized portion of the waveguide tube, and determining the relative position of the ram from the return signal.

In another aspect, the present disclosure is directed to a method to add instrumentation to a ram blowout preventer including removing a cylinder head enclosure, removing a piston tail from a hydraulic ram piston, installing a replacement piston tail, the replacement piston tail comprising a bore, installing a replacement cylinder head enclosure, wherein the replacement cylinder head includes an instrumentation port, attaching a magnet assembly to the piston tail, and disposing a magnetostrictive sensor from the replacement cylinder head enclosure such that the magnetostrictive sensor is configured to engage and disengage the piston tail bore as the hydraulic ram piston reciprocates.

Other aspects and advantages of the invention will be apparent from the following description and the appended claims.

DETAILED DESCRIPTION

In one aspect, embodiments disclosed herein relate to a ram blowout preventer including instrumentation for determining a position of a ram within the blowout preventer. In another aspect, embodiments disclosed herein relate to methods for determining the position, speed, or closure rate of a ram in a ram blowout preventer.

Figure 1:
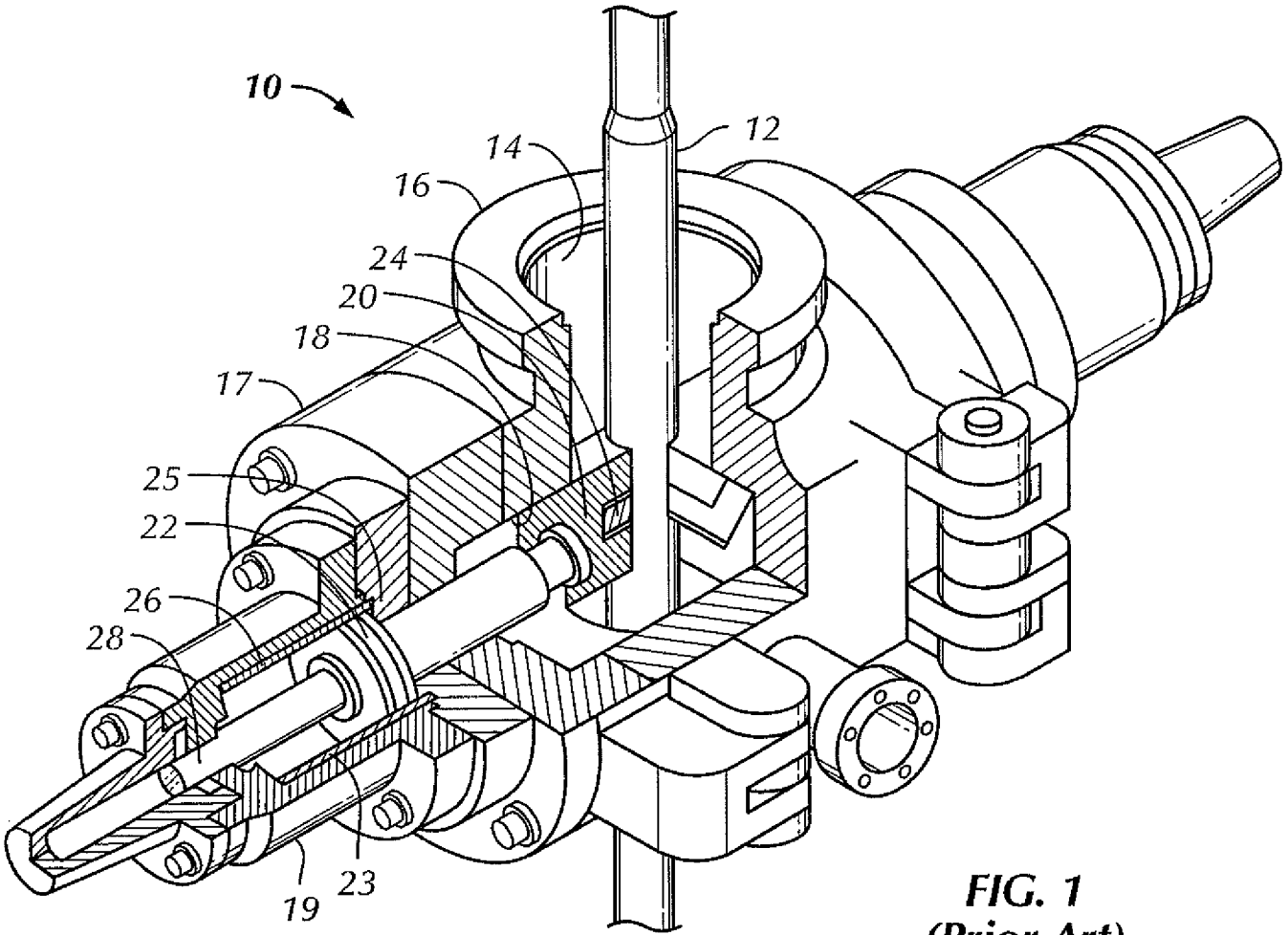
FIG. 1 (Prior Art)
FIG. 1 illustrates a partial sectional view of a prior art ram blowout preventer.

FIG. 1 illustrates a ram-type blowout preventer 10. A well pipe 12, which may be part of a drill string located at the top of a well being drilled or a part of a production string of a well under oil or gas production, is shown passing through a central vertical bore 14 in the body 16 of the blowout preventer 10. The body 16 may include opposing horizontal passageways 18 transverse to bore 14. The horizontal passageways may extend outwardly into bonnets 17 connected to body 16. Operating in passageways 18 are rams 20 driven by hydraulic pistons 22 in their respective cylinder liners 23 located in respective hydraulic cylinders 19 connected outwardly of bonnets 17. The pistons 22 may reciprocate the rams 20 back and forth in the passageways 18 and to open and close packers or wear pads 24 in the faces of rams 20 with respect to the surface of pipe 12. Hydraulic fluid connections (not shown) operate in connection with opening chamber 25 and closing chamber 26 to position the rams 20.

As illustrated, ram blowout preventer 10 may include a tail portion 28 connected to piston 22. Tail 28 of the piston 22 reciprocates within a cylinder head 30, which may be bolted or otherwise connected to cylinder 19.

It is desirable to know or to locate the position of rams 20, as described above. This may be accomplished by locating components of a magnetostrictive sensor within a hydraulic cylinder head enclosure that connects to cylinder 19 shown in FIG. 1. Those having ordinary skill in the art will appreciate that embodiments disclosed herein are broadly applicable to any ram-type BOP, but even more broadly to any device employing rams.

Figure 2:
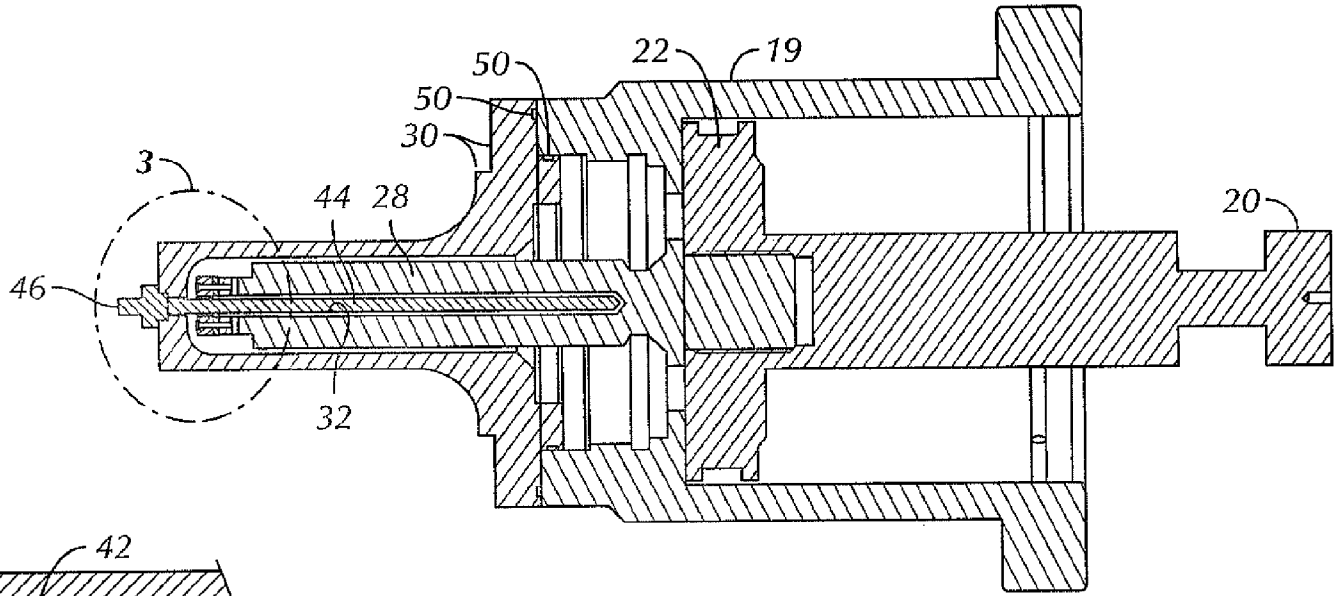
FIG. 2 is a sectional view of a ram blowout preventer bonnet assembly in accordance with embodiments disclosed herein.
Figure 3:
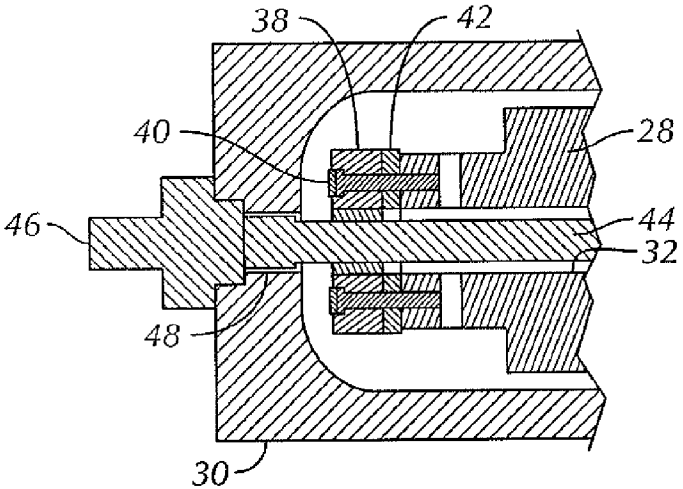
FIG. 3 is a detailed view of a portion of the ram blowout preventer bonnet assembly of FIG. 2.

FIGS. 2 and 3 illustrate a cylinder head and sensor arrangement according to embodiments disclosed herein. Cylinder head 30 may be connected to cylinder 19 via screwed, welded, flanged, or any other connections known in the art. Piston 22, shown in its fully opened position, may be connected to piston tail 28 having a piston tail bore 32 extending at least partially through piston tail 28. Magnet assembly 38 may be concentric with and attached to piston tail 28 via screws 40, non-magnetic screws in some embodiments. A spacer 42, such as an o-ring, may be placed between magnet assembly 38 and piston tail 28.

Magnet assembly 38 may include two or more permanent magnets. In some embodiments, magnet assembly 38 may include three magnets; four magnets in other embodiments; and more than four magnets in yet other embodiments.

A stationary waveguide tube 44 may be located within cylinder head 30, and may at least partially extend into the piston tail bore 32 of piston tail 28. Preferably, piston tail 28 is radially spaced from the waveguide tube 44 so as not to interfere with the movement of piston 22 or to cause wear on waveguide tube 44. Similarly, magnet assembly 38 may be radially spaced apart from waveguide tube 44. In selected embodiments, magnets of the magnet assembly 38 may be in a plane transverse to waveguide tube 44.

Additionally, a conducting element or wire (not shown) may be located through the center of waveguide tube 44. Both the wire and waveguide tube 44 may be connected to a transducer 46, located external to cylinder head 30, through a communications port 48. Transducer 46 may also include a suitable means for placing an interrogation electrical current pulse on the conducting wire.

O-rings 50, located between cylinder head 30 and hydraulic cylinder 19, may seal against leaks. O-rings may also be used to seal the connection between communications port 48 and transducer 46.

As ram 20 moves axially, piston tail 28 and magnet assembly 38 axially move the same amount. Thus, by the operation of the magnetostrictive sensor disposed therein, it is possible to determine on a continuous basis the position of ram 20.

With regard to operation of the magnetostrictive sensor, magnetostriction refers to the ability of some metals, such as iron or nickel or iron-nickel alloys, to expand or contract when placed in a magnetic field. A magnetostrictive waveguide tube 44 may have an area within an external magnet assembly 38 that is longitudinally magnetized as magnetic assembly 38 is translated longitudinally about waveguide tube 44. Magnetic assembly 38, as described above, includes permanent magnets that may be located at evenly spaced positions apart from each other, in a plane transverse to waveguide tube 44, and radially equally spaced with respect to the surface of waveguide tube 44. An external magnetic field is established by magnetic assembly 38, which may longitudinally magnetize an area of waveguide tube 44.

Waveguide tube 44 surrounds a conducting wire (not shown) located along its axis. The conducting wire may be periodically pulsed or interrogated with an electrical current in a manner well-known in the art, such as by transducer 46 located on the outside of enclosure 30. Such a current produces a toroidal magnetic field around the conducting wire and waveguide tube 44. When the toroidal magnetic field intersects with the magnetic field generated by the magnetic assembly 38, a helical magnetic field is induced in waveguide tube 44 to produce a sonic pulse that travels toward both ends of the waveguide tube 44. Suitable dampers (not shown) at the ends of waveguide tube 44 may prevent echo reverberations of the pulse from occurring. However, at the transducer end or head, the helical wave is transformed to a waveguide twist, which exerts a lateral stress in very thin magnetostrictive tapes connected to waveguide tube 44. A phenomenon known as the Villari effect causes flux linkages from magnets running through sensing coils to be disturbed by the traveling stress waves in the tapes and to develop a voltage across the coils. Transducer 46 may also amplify this voltage for metering or control purposes.

Because the current pulse travels at nearly the speed of light, and the acoustical wave pulse travels roughly at only the speed of sound, a time interval exists between the instant that the head-end transducer receives each pulse compared with the timing of the electrical pulse produced by the head-end electronics. This time interval is a function of the distance that external magnet assembly 38 is from the transducer end of the tube. By carefully measuring the time interval and dividing by the tube's velocity of propagation, the absolute distance of the magnet assembly from the head end of the tube can be determined.

In the event of loss of signal, there is no loss of information, and no re-zeroing or re-homing of any reading is necessary. The reading is absolutely determined by the location of magnetic assembly 38 with respect to transducer 46.

With the knowledge of the absolute position of the ram, it can be determined if the ram is completely closed, if the ram is hung up, to what degree the packer or wear pad on the front of the ram is worn, and to what degree there is backlash or wear in the piston mechanism. From successive interrogation pulses, it is also possible to measure piston closing speed or velocity and the rate of movement or acceleration and deceleration of the piston.

It may also be desired to add instrumentation to existing ram blowout preventers. An existing ram blowout preventer, as described with respect to FIG. 1, may include a body, a vertical bore through the body adapted for the passage of tubing or other objects, a horizontal bore through the body intersecting the vertical bore through the body, two ram assemblies disposed in the horizontal bore in opposite sides of the body, the ram assemblies adapted for controlled lateral movement to and from the vertical bore, movable hydraulic pistons connected at a first end to the ram assemblies for positioning the rams, a piston tail connected to a second end of one of the movable hydraulic pistons, and a cylinder head enclosure for enclosing the piston tail connected to the body.

To add instrumentation to an existing ram blowout preventer, it may be possible to only replace or modify a portion of the ram blowout preventer, reducing the cost necessary to upgrade existing equipment to include instrumentation. For example, it may be possible to add instrumentation to an existing ram blowout preventer by replacing or modifying only the cylinder head enclosure and the piston tail.

The existing cylinder head enclosure and piston tail may be removed. The removed piston tail may be modified to have a central bore for instrumentation and reattached to the hydraulic piston, or a new piston tail having a central bore may be attached to the hydraulic piston. Likewise, the cylinder head enclosure may be modified to include an instrumentation port, or a new cylinder head enclosure having an instrumentation port may be connected to the ram blowout preventer body. A magnet assembly may be attached to the piston tail having a central bore, and a magnetostrictive sensor, as described above, may be at least partially disposed in the central bore of the piston tail.

Following the addition of the instrumentation to an existing ram blowout preventer, it may be necessary to calibrate the magnetostrictive sensor to the fully open and fully closed positions of the ram. Additionally, the instrumentation for determining a position of the ram may be operatively connected to a digital control system. The digital control system may then be used to monitor, display, and/or control the position of the ram based upon an electronic signal from the magnetostrictive sensor.

Advantageously, embodiments disclosed herein may provide instrumentation for ram blowout preventers that accurately measure the position, velocity, and acceleration of a ram, and which are easy to install. Additionally, embodiments disclosed herein are non-invasive of the hydraulic cylinder cavity, which may provide additional advantages.

For one example of an addition advantage, in some embodiments, the magnetostrictive sensor may be serviceable during operation of the ram blowout preventer. Seals provided between the piston tail, the cylinder head and/or the hydraulic cylinder may prevent leakage from the hydraulic cylinder into the cylinder head, allowing the ram blowout preventer to continue operations while servicing the transducer, the conductive wire, or the waveguide tube.

As another example, embodiments disclosed herein may allow for flexibility in the components of ram blowout preventers while providing for consistent construction of the ram blowout preventers. For example, customers may desire ram blowout preventers that are provided with or without instrumentation. The integrity of the rod connecting the ram and the piston is not compromised by the presence of an internal bore for placing a sensor, as where the sensor is disposed in the rod, thus not requiring strengthening or modification of rods for use with and without instrumentation. Additionally, cylinder heads and tails providing for instrumentation may be readily interchanged with cylinder heads and tails that do not provide for instrumentation ports. In this manner, parts may be interchangeable, existing ram blowout preventers may be easily modified to include instrumentation, and customers will be allotted flexibility in product choices without fear of inconsistent manufacture.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A ram-type blowout preventer, comprising:

a body;

a vertical bore through the body;

a horizontal bore through the body intersecting the vertical bore;

a pair of ram assemblies disposed in the horizontal bore on opposite sides of the body, wherein the ram assemblies are adapted for controlled lateral movement to and from the vertical bore, wherein each ram assembly comprises a hydraulic piston connected at a first end to a ram block and at a second end to a piston tail;

a pair of cylinder heads configured to be attached to the body and to receive corresponding piston tails;

a magnetostrictive waveguide tube attached with a first end to one of the pair of cylinder heads, a second end of the magnetostrictive waveguide tube being free standing and extending into a bore formed within at least one piston tail;

a permanent magnet disposed upon the at least one piston tail; and the magnetostrictive waveguide tube comprising a conducting wire to receive an interrogation pulse from a transducer, wherein the interrogation pulse generates a helical return signal in response to a relative position of the permanent magnet with respect to the waveguide tube, wherein the transducer is configured to receive the helical return signal and output a position of the ram block corresponding to the at least one piston tail.

2. The ram-type blowout preventer of claim 1, wherein the magnetostrictive waveguide tube is longitudinally magnetized.

3. The ram-type blowout preventer of claim 1, wherein the interrogation pulse generates a toroidal magnetic field around the wire.

4. The ram-type blowout preventer of claim 3, wherein the helical return signal is created in response to the interaction of the toroidal magnetic field with a longitudinal magnetized area of the waveguide tube.

5. The ram-type blowout preventer of claim 1, wherein the magnetostrictive waveguide tube has a cantilever structure.

6. The ram-type blowout preventer of claim 1, further comprising:

a seal disposed between the permanent magnet and the at least one piston tail.

7. The ram-type blowout preventer of claim 1, wherein the horizontal bore is different from the bore formed within the at least one piston tail.

8. The ram-type blowout preventer of claim 1, wherein the permanent magnet is concentric to the at least one piston tail.

9. The ram-type blowout preventer of claim 1, wherein the at least one piston tail is radially spaced around the waveguide tube.

10. A method to determine a relative position of a ram, the method comprising:

reciprocally engaging a magnetostrictive waveguide tube within a bore formed within a piston tail;

longitudinally magnetizing a portion of the waveguide tube with at least one permanent magnet fixed on the piston tail;

pulsing a conductive wire located inside the waveguide tube to generate a toroidal magnetic field, wherein a return signal is produced when the toroidal magnetic field encounters the longitudinally magnetized portion of the waveguide tube; and determining the relative position of the ram from the return signal.

11. The method of claim 10, further comprising sensing the return signal over a time period to determine a velocity of the ram.

12. The method of claim 11, further comprising determining a rate of closure of the ram.

13. A method to add instrumentation to a ram blowout preventer, the method comprising:

removing a cylinder head enclosure;

removing a piston tail from a hydraulic ram piston;

installing a replacement piston tail, the replacement piston tail comprising a bore;

installing a replacement cylinder head enclosure, the replacement cylinder head comprising an instrumentation port;

attaching a magnet assembly on the piston tail; and disposing a magnetostrictive sensor from the replacement cylinder head enclosure such that the magnetostrictive sensor is configured to engage and disengage the piston tail bore as the hydraulic ram piston reciprocates.

14. The method of claim 13, further comprising calibrating the magnetostrictive sensor to indicate a fully open position of the ram and a fully closed position of the ram.

15. The method of claim 13, further comprising:

operatively connecting the magnetostrictive sensor to a digital control system; and determining a position of the ram with the magnetostrictive sensor.

16. The method of claim 15, further comprising displaying the position of the ram based upon an electronic signal from the magnetostrictive sensor.

17. The method of claim 15, further comprising controlling the position of the ram based upon an electronic signal from the magnetostrictive sensor.

* * * * *